US012723292B2

(12) United States Patent
Engler et al.

(10) Patent No.: US 12,723,292 B2
(45) Date of Patent: Sep. 1, 2026

(54) ALUMINIUM ALLOY STRIP OPTIMIZED FOR FORMING AND METHOD FOR MANUFACTURE

(71) Applicants: Olaf Engler, Bonn (DE); Holger Aretz, Spessart (DE); Janina Krause, Düsseldorf (DE); Martin Cremer, Siegen (DE)

(72) Inventors: Olaf Engler, Bonn (DE); Holger Aretz, Spessart (DE); Janina Krause, Düsseldorf (DE); Martin Cremer, Siegen (DE)

(73) Assignee: Speira GmbH, Grevenbroich (DE)

( * ) Notice: Subject to any disclaimer, the term of this patent is extended or adjusted under 35 U.S.C. 154(b) by 93 days.

(21) Appl. No.: 18/587,065

(22) Filed: Feb. 26, 2024

(65) Prior Publication Data

US 2024/0200171 A1 Jun. 20, 2024

Related U.S. Application Data

(63) Continuation of application No. PCT/EP2022/074329, filed on Sep. 1, 2022.

(30) Foreign Application Priority Data

Sep. 3, 2021 (EP) ..... 21194864

(51) Int. Cl.
*C22C 21/08* (2006.01)
*C21D 8/0221* (2026.01)
(Continued)

(52) U.S. Cl.
CPC ..... *C22C 21/08* (2013.01); *C21D 8/0226* (2013.01); *C21D 8/0236* (2013.01); *C21D 8/0273* (2013.01); *C22F 1/047* (2013.01)

(58) Field of Classification Search
None
See application file for complete search history.

(56) References Cited

U.S. PATENT DOCUMENTS 5,516,374 A * 5/1996 Habu ..... C22F 1/047 148/695
2015/0159251 A1* 6/2015 Hentschel ..... C22C 21/06 148/552
2020/0157668 A1 5/2020 Shinzato et al.

FOREIGN PATENT DOCUMENTS

CN 1938439 A 3/2007
CN 102421924 A 4/2012
(Continued)

OTHER PUBLICATIONS

Rooy, Elwin. ASM Handbook: vol. 15 Casting, ASM International. p. 1001-1008. (Year: 2008).*

*Primary Examiner* — Keith D. Hendricks
*Assistant Examiner* — Janell C Morillo
(74) *Attorney, Agent, or Firm* — Reinhart Boerner Van Deuren P.C.

(57) ABSTRACT

An aluminium alloy strip made of an aluminium alloy, a method for manufacturing the aluminium alloy strip and its preferred use are described. The aluminium alloy strip provides resistance to intercrystalline corrosion, strength and improved forming properties, by the aluminium alloy strip having an aluminium alloy with the following composition in % by weight:

Si≤0.10%,
Fe≤0.25%,
0.20%≤Mn≤0.30%
4.72%≤Mg≤4.95%,
Cu≤0.10%,
Cr≤0.02%,
Ni≤0.01%, (Continued)

Zn≤0.10%,
Ti≤0.04%,
remainder being Al with unavoidable impurities individually ≤0.05%, in total ≤0.15%. The aluminium alloy strip has an average secondary phase density of less than 250 per 1000 $\mu m^2$, the total number of secondary phases determined in at least 10 measuring fields in relation to the total measuring surface of all examined measuring fields resulting in the secondary phase density.

16 Claims, 4 Drawing Sheets

(51) Int. Cl.
*C21D 8/0247* (2026.01)
*C22F 1/047* (2006.01)

(56) References Cited

FOREIGN PATENT DOCUMENTS

| | | | |
|---|---|---|---|
| CN | 102439185 | A | 5/2012 |
| EP | 2698216 | A1 | 2/2014 |
| EP | 3741875 | A1 | 11/2020 |
| JP | 2001303164 | A | 10/2001 |
| JP | 2018524468 | A | 8/2018 |
| JP | 2019026876 | A | 2/2019 |
| WO | WO 2016/207274 | A1 | 12/2016 |

* cited by examiner

ALUMINIUM ALLOY STRIP OPTIMIZED FOR FORMING AND METHOD FOR MANUFACTURE

CROSS-REFERENCE TO RELATED PATENT APPLICATIONS

This patent application is a continuation of International Application No. PCT/EP2022/074329, filed on Sep. 1, 2022, which claims the benefit of priority to European Patent Application No. 21194864.1, filed Sep. 3, 2021, the entire teachings and disclosures of both applications are incorporated herein by reference thereto.

BACKGROUND OF THE INVENTION

The invention relates to an aluminium alloy strip made of an aluminium alloy, a method for manufacturing the aluminium alloy strip and its preferred use.

In particular, aluminium-magnesium (AlMg) alloys of type AA 5xxx are used in the form of sheets or strips for the construction of welded or joined components in ship, automotive and aircraft construction. The aluminium-magnesium alloys are characterised by an increasing magnesium content due to their high strength and, in the case of magnesium contents above 3%, an increasing formability. For this reason, aluminium-magnesium alloys of type AA 5xxx can increasingly replace materials made of steel in automotive construction, for example, and can thus contribute to the further weight reduction of motor vehicles.

AlMg alloys of type AA 5xxx with Mg contents of more than 3%, in particular more than 4%, are increasingly prone to intercrystalline corrosion when exposed to elevated temperatures. At temperatures of 70-200° C., non-precious $Al_5Mg_3$ phases are precipitated along the grain boundaries, which are referred to as β particles and can be selectively dissolved in the presence of a corrosive medium. As a result, in particular the aluminium alloy of type AA 5182 (Al 4.5% Mg 0.4% Mn) with very good strength properties and very good formability is not used in heat-exposed areas if the presence of a corrosive medium, for example water in the form of moisture, must be expected. This applies in particular to the components of a motor vehicle, which are usually subjected to cathodic dip painting (CDP) and then dried in a baking process, since this baking process can already cause sensitisation with regard to intercrystalline corrosion in conventional aluminium alloy strips. In addition, for use in the automotive sector, the forming during the manufacture of a component and the subsequent operating load of the component must be taken into account.

An aluminium alloy strip is known from the international patent application WO 2014/0298531 A1 which has a magnesium content above 4% by weight and is suitable for components of a motor vehicle. Despite providing high strengths, it exhibits very good resistance to intercrystalline corrosion. However, it has been shown that the formability of this aluminium alloy strip made of an aluminium alloy of type AA 5182, which is particularly resistant to intercrystalline corrosion, can be improved.

A further development of this aluminium alloy strip with regard to formability is therefore known from the international patent application WO 2014/029856 A1. Here, the aluminium alloy strip was optimised with regard to formability with an almost identical alloy concept. The subject matter of both international patent applications is aluminium strips that have a Mg content of up to a maximum of 4.50% by weight within the specification of the aluminium alloy of type AA 5182.

The Japanese patent application JP 2001 303164 A discloses an aluminium alloy of the type AA5xxx whose secondary phase densities were determined for secondary phases with a maximum length of at least 3 μm and more.

The international patent application WO 2016/207274 A1 discloses annealed aluminium alloy strips and methods for their production.

From the US patent application US 2020/0157668 A1, soft-annealed aluminium alloy strips are known whose secondary phase density was maximized for copper-containing secondary phases with an equivalent circular diameter of 0.3 μm to 4 μm.

It has now been determined that there is further potential for improvement with regard to formability within the specification of the aluminium alloy of type AA 5182, without deteriorating the other properties such as the provision of the necessary strength and corrosion resistance. It has been found that the usual key figures for formability, for example the equal elongation Ag or the elongation at fracture values $A_{80mm}$, are not sufficiently meaningful with regard to the practical use of the aluminium alloy sheets in the forming processes.

The standard DIN EN ISO 12004-2:2021-07 specifies test conditions that allow a statement to be made about the permissible main and secondary form changes of aluminium sheets in forming processes so that a safe forming process can be provided. The main form changes and secondary form changes determined in accordance with this standard result from the forming limit change curve, which characterise the specific behaviour of the sheet to be formed in the drawing test. The provision of the forming limit change curve is achieved by means of a form change analysis of defective drawn parts for the determination of form change diagrams dependent on the drawn part and the forming process.

On samples with specific geometry, a deterministic grid with exact dimensions or a stochastic pattern is applied or optically projected onto the non-deformed surface. The specifically cut sample part is then, for example, deformed in accordance with the Nakajima method using a defined punch in a precisely defined matrix until cracking, after which the test is aborted. All values given in this document for the main form change ε1 refer to the test according to the Nakajima method in accordance with EN ISO 12004-2: 2021-07. The main form change ε1 is determined here on samples with a width of 100 mm. All values given are average values from 3 samples.

All other mechanical parameters are measured in accordance with DIN EN ISO 6892. Since the grain size of a material is always given in the form of a distribution, all the information given on the grain size refers to the average grain size. The average grain size can be determined according to ASTM E1382.

SUMMARY OF THE INVENTION

The object of the present invention is to provide an aluminium alloy strip, in particular for the manufacture of body parts of a motor vehicle, preferably body inner parts, which, in addition to the necessary resistance to intercrystalline corrosion, provides the required strength and at the same time improved forming properties.

According to a first teaching of the present invention, said object is achieved by providing an aluminium alloy strip, which has an aluminium alloy with the following composition in % by weight:

Si≤0.10%,
Fe≤0.25%,
0.20%≤Mn≤0.30%
4.72%≤Mg≤4.95%,
Cu≤0.10%,
Cr≤0.02%,
Ni≤0.01%,
Zn≤0.10%,
Ti≤0.04%,
remainder being Al with unavoidable impurities individually ≤0.05%, in total ≤0.15%, wherein the aluminium alloy strip has an average secondary phase density of less than 250 per 1000 $\mu m^2$.

During intensive investigations, the inventors have recognised that an advantageous increase in formability can be achieved in aluminium alloy strips, having the aforementioned aluminium alloy, by limiting the secondary phase density to less than 250 per 1000 $\mu m^2$, while at the same time retaining the advantages of the aluminium alloy of type AA 5182 with regard to the corrosion resistance and mechanical strength of the aluminium alloy strip. Secondary phases are usually $Al_6Mn$, alpha-Al (Fe,Mn)Si and $Mg_2Si$. According to the findings of the inventors, a high number of secondary phases leads to a limitation of the forming behaviour and is particularly noticeable in the complex deep drawing processes for the manufacture of body components, for example. By selecting a specific alloy composition in combination with manufacturing processes that are just as specific, the secondary phase density could be reduced to values below 250 per 1000 $\mu m^2$.

The secondary phase density, i.e. the (surface) density of the dispersoids, is determined in this document under light microscopy as follows. A sample of the aluminium alloy strip to be examined is embedded and prepared in a longitudinal section using generally accepted metallographic methods. After grinding and polishing the section, the sample is etched for one minute at room temperature in a diluted aqueous solution of sulphuric acid and hydrofluoric acid. For this purpose, a solution of 100 $cm^3$ 10% concentrated sulphuric acid is mixed with 100 $cm^3$ of another solution consisting of 60 $cm^3$ water and 40 $cm^3$ 5% hydrofluoric acid. After etching, the section is rinsed with distilled water and dried for subsequent light microscopic examination. The etching carried out marks the secondary phases in the structure such that their surface density can be determined with good accuracy in the light microscope. To ensure sufficient statistical relevance, a minimum of 10 statistically distributed image sections are analysed as measuring fields at a high magnification (1000:1) with an oil lens with the light microscope, so that a total of at least 2000 secondary phases have been recorded. The total number of determined secondary phases, in relation to the total measuring area of all examined measuring fields, then results in the surface density of the secondary phases or secondary phase density (specified in number per area, e.g. number per 1000 $\mu m^2$).

In the alloy composition, the silicon content was reduced to a maximum of 0.10% by weight. Silicon forms alpha-Al (Fe,Mn)Si and $Mg_2Si$ precipitates as secondary phases in magnesium-containing aluminium alloys. As previously explained, these impair the formability of the aluminium alloy strip. A preferred silicon content is therefore a maximum of 0.08% by weight.

Iron is predominantly bound in the so-called casting phases, but is also involved in the formation of secondary precipitates. Therefore, the reduction of the iron content to a maximum of 0.25% by weight, preferably to a maximum of 0.20% by weight, contributes to an improvement in formability.

Manganese is a typical dispersoid former, whereby the dispersoid particles effectively prevent displacement movements of atoms from the metal crystal bond from taking place. Thus, dispersoids contribute to a desired increase in yield strength. Furthermore, dispersoids containing Mn help to control the grain size of the aluminium alloy strip. However, dispersoid particles limit the forming behaviour. The aluminium alloy strip therefore has an Mn content of 0.20% by weight to 0.30% by weight. Below an Mn content of 0.20% by weight, the strength-increasing effect of the dispersoids is reduced and the aluminium alloy strip can exhibit undesired grain enlargement during heat treatment. At a content of more than 0.30% by weight of manganese, the dispersion obstructs the expansion of the material too much, so that the forming behaviour is not optimal. An Mn content optimised for the aspects of the forming behaviour can be provided with 0.20% by weight≤Mn≤0.26% by weight.

Magnesium is contained in the aluminium alloy according to the invention in a content of 4.72% by weight to 4.95% by weight, preferably from 4.80% by weight to 4.92% by weight. It has been found that with these magnesium contents in particular, not only are high strengths achieved despite reduced proportions of dispersoid formers increasing the strength, but at the same time the forming behaviour is improved. However, higher Mg contents lead to an excessive sensitivity of the material to intercrystalline corrosion, as described above.

In order to optimise the forming behaviour, the copper content has also been limited to a maximum of 0.10% by weight. Copper increases the strength of the aluminium alloy strip even at low contents, but also leads to a deterioration of the general corrosion behaviour at low contents. Therefore, preferred contents of copper are a maximum of 0.07% by weight, particularly preferably at least 0.02% by weight and less than 0.04% by weight.

The alloying element chromium is a very effective dispersoid former and is therefore contained in the aluminium alloy with a content of a maximum of 0.02% by weight, preferably 0.01% by weight and particularly preferably a maximum of 0.008% by weight.

The same also applies to the nickel content due to the tendency to form dispersoid particles at the lowest contents 10. The Ni content is therefore reduced to a maximum of 0.01% by weight, preferably to 0.005% by weight.

The corrosion resistance of the aluminium alloy strip is adversely affected by zinc, which is contained in a content of a maximum of 0.10% by weight, preferably a maximum of 0.01% by weight, particularly preferably a maximum of 0.008% by weight in the aluminium alloy.

The titanium used for grain refining in the melting process must be limited to a maximum of 0.04% by weight, preferably a maximum of 0.02% by weight, since titanium also forms dispersoids and tends to segregate strongly in larger concentrations. Since the titanium originating for example from grain refining agents supports the melting process and thus improves the casting of the rolling ingot, a titanium content of 0.005% by weight to a maximum of 0.02% by weight is preferably provided in the aluminium alloy. This range of titanium allows a compromise to be achieved between melting properties and the number of secondary precipitates.

According to a first embodiment of the aluminium alloy strip, the aluminium alloy strip has a secondary phase density of less than 220 per 1000 $\mu m^2$, 30 particularly preferably less than 200 per 1000 $\mu m^2$. It was possible to demonstrate that a further reduction of the secondary phase density in the aluminium alloy strip can be achieved by selecting the aluminium alloy elements in conjunction with the manufacturing process of the aluminium alloy strip. These aluminium alloy strips exhibited a further increase in forming behaviour while simultaneously providing high mechanical strengths and good corrosion resistance.

The aluminium alloy strip has very good forming properties in microstructure state O or H111. The microstructure state O is characterised by a recrystallised microstructure, which enables maximum forming. In state H111, the aluminium alloy strip in state O has been slightly solidified, for example by stretching or straightening the aluminium alloy strip. The state H111 is therefore preferably used in the processing of aluminium alloy sheets, since the aluminium alloy sheets have little distortion here and still achieve particularly high forming values.

Further investigations have shown that the aluminium alloy strip has an average grain size of 15 μm to 30 μm according to a further embodiment. It has been found that the corrosion resistance of the aluminium alloy with the present alloy composition for grain sizes from 15 μm to 30 μm meets the requirements for body applications. At the same time, the smaller grain sizes contribute to improved formability.

The aluminium alloy strip is preferably cold-rolled to provide the necessary dimensional accuracy and surface quality for the preferred application in automotive construction.

The end thicknesses of the cold-rolled aluminium alloy strip are 0.5 mm to a maximum of 4 mm, preferably 0.8 mm to 2.5 mm, according to one embodiment. In particular in these specified thickness ranges, the aluminium alloy strip can provide the significantly improved forming properties in combination with conventional forming processes and tools.

According to a next embodiment of the aluminium alloy strip, it has an Ae value transverse to the rolling direction of less than 1.0%, preferably less than 0.9%. The Ae value is also referred to as yield-strength extensometer elongation. The Ae value is measured transverse to the rolling direction in accordance with DIN EN ISO 6892 and is specified in %. The Ae value of an aluminium alloy strip is characteristic for the formation of Lüders bands during the forming of the aluminium alloy strip, which are, for example, undesirable for body components. The smaller the Ae value, the fewer Lüders bands are generated. With values of less than 1.0% or less than 0.9% transverse to the rolling direction, the aluminium alloy strip can be designated as substantially free of Lüders bands.

Finally, an embodiment of the aluminium alloy strip according to the invention with a sheet thickness of 1.2 mm and a sample width b) of 100 mm according to DIN EN ISO 120004-2 in the test according to Nakajima has an average main form change ε1 of more than 0.200. This main form change value could be achieved in the aluminium alloy strip according to the invention by adjusting the reduced secondary phase density taking into account a manufacturing process adapted to the material. The main ε1 form change 1 at a sample width b) of 100 mm according to Nakajima reflects the complex interaction of the microstructure of the aluminium alloy strip in the drawing process in a single parameter and shows a significant increase compared to the main ε1 form changes 1 of form-optimised aluminium alloy strips of type AA 5182 achieved so far. For all values specified here, the specification of the sample width of 100 mm refers to the value b) of a sample with axially parallel recess length a) in accordance with FIG. 2 of DIN EN ISO 120004-2 (6.1.2 Sample geometry).

At the same time, according to a further embodiment, the aluminium alloy strip provides a yield strength $Rp_{0.2}$ transverse to the rolling direction of at least 115 MPa, preferably at least 120 MPa in the microstructure state O or H111, so that the strength requirements in motor vehicle construction are also fulfilled by the form-optimised aluminium alloy strip.

The mass losses of the aluminium alloy strip due to intercrystalline corrosion are 13 $mg/cm^2$ to 19 $mg/cm^2$ after a thermal load of 195° C. for 45 minutes measured according to ASTM G67. This heat load corresponds to the maximum heat load that the component can experience during a cathodic dip painting process and thus shows that corrosion problems are not to be expected in the subsequent use of the component.

According to a further teaching of the invention, the aluminium alloy strip according to the invention is manufactured using a method which has the following steps: Casting of a rolling ingot from an aluminium alloy with the following composition:

- Si≤0.10%, preferably ≤0.08%,
- Fe≤0.25%, preferably ≤0.20%,
- 0.20%≤Mn≤0.30%, preferably 0.20%≤Mn≤0.26%,
- 4.72%≤Mg≤4.95%, preferably 4.80%≤Mg≤4.92%,
- Cu≤0.10%, preferably Cu≤0.07, particularly preferably Cu<0.04%,
- Cr≤0.02%, preferably Cr≤0.01, particularly preferably Cr≤0.008%, Ni≤0.01%, preferably Ni≤0.005%,
- Zn≤0.10%, preferably Zn≤0.01%, particularly preferably Zn≤0.008%,
- Ti≤0.04%, preferably Ti≤0.02%,
- the remainder being Al and unavoidable impurities individually ≤0.05%, in total ≤0.15%,
- Homogenisation of the rolling ingot at 480° C. to 550° C. for at least 0.5 h,
- Hot rolling of the rolling ingot to a hot strip end thickness of 3 to 6 mm
- Cold rolling of the aluminium alloy strip at end thickness with a rolling degree of 40% to 60%, preferably 50% to 60% and
- Soft annealing of the finished rolled aluminium alloy strip at more than 500° C., preferably 510° C. to 540° C. in a continuous furnace.

In addition to the particularly critical selection of the aforementioned alloy components of the aluminium alloy, which are responsible for the secondary phase density, it has been found that, in connection with the alloy composition, the aforementioned method characteristics and the selection of the rolling degree of the cold rolling at end thickness of 40% to 60% in connection with the soft annealing of the finished-rolled aluminium alloy strip at more than 500° C., preferably at 510° C. to 540° C. in a continuous furnace, represent features which ensure the provision of a low secondary phase density per 1000 $\mu m^2$.

According to a further variant of the method according to the invention for the manufacture of the aluminium alloy strip, the following method steps are alternatively carried out after hot rolling:

Cold rolling of the hot-rolled aluminium alloy strip to an intermediate thickness determined in such manner that the final cold rolling degree at end thickness is 40% to 60% preferably 50% to 60%, Intermediate annealing of the aluminium alloy strip at 300° C. to 500° C., Cold rolling of the aluminium alloy strip at end thickness with a rolling degree of 40% to 60%, preferably 50% to 60%

Soft annealing of the finished rolled aluminium alloy strip at more than 500° C., preferably 510° C. to 540° C. in a continuous furnace.

Irrespective of whether the aluminium alloy strip was manufactured with or without intermediate annealing, it has been found that the final cold rolling at end thickness in combination with the stressed soft annealing in the continuous furnace surprisingly produces a particular combination of properties of the aluminium alloy strip. At the same time, soft annealing in the continuous furnace at the aforementioned temperatures achieves grain sizes of 15 μm to 30 μm, which not only contribute to a surprisingly good corrosion resistance of the correspondingly manufactured aluminium alloy strip, but also promote the forming properties.

According to a further embodiment of the method according to the invention, the duration of the soft annealing of the finished aluminium alloy strip in the continuous furnace is between 5 seconds and 300 seconds, wherein an interval of 10 seconds to 60 seconds is preferably aimed for. At the specified times, complete recrystallisation of the microstructure can already be achieved in the continuous furnace, whereby the duration is also adapted to the respective thickness of the strip.

According to a further embodiment of the method, the hot rolling of the rolling ingot consists of the steps pre-rolling to a thickness of 30 mm to 40 mm at a starting temperature of at least 450° C. and a finish rolling to hot strip end thickness with a reeling temperature of 300° C. to 350° C. It has been shown that hot rolling can be advantageously optimised in terms of providing a low secondary phase density and contributes to stable process control by complying with these parameters.

Lastly, the aluminium alloy strip according to the invention is preferably used for the manufacture of body inner part, in particular a door inner part, an engine hood inner part or a trunk cover inner part of a motor vehicle. Body inner parts are often complexly formed to provide specific strengths to provide the vehicle body structure. This is why body inner parts are also manufactured from high-strength materials, such as the aluminium alloy in question. At the same time, however, it must also be possible to form these in a complex manner in order to provide the body inner parts from as few individual components as possible. This saves additional work steps with regard to the joining technology, for example joining or welding different components. At the same time, body inner parts are also exposed to corrosive conditions, so good corrosion resistance is also required.

The aluminium alloy strip meets these conditions to a particular extent and is therefore predestined for this use.

Due to the optimised forming behaviour of the aluminium alloy strip according to the invention without any loss in terms of strength and corrosion resistance, the aluminium alloy strip is optimally suited for the manufacture of complexly formed body inner parts.

BRIEF DESCRIPTION OF THE DRAWINGS

The invention will be described in greater detail below using exemplary embodiments in connection with the drawings, The drawing shows.

DETAILED DESCRIPTION

Figure 1:
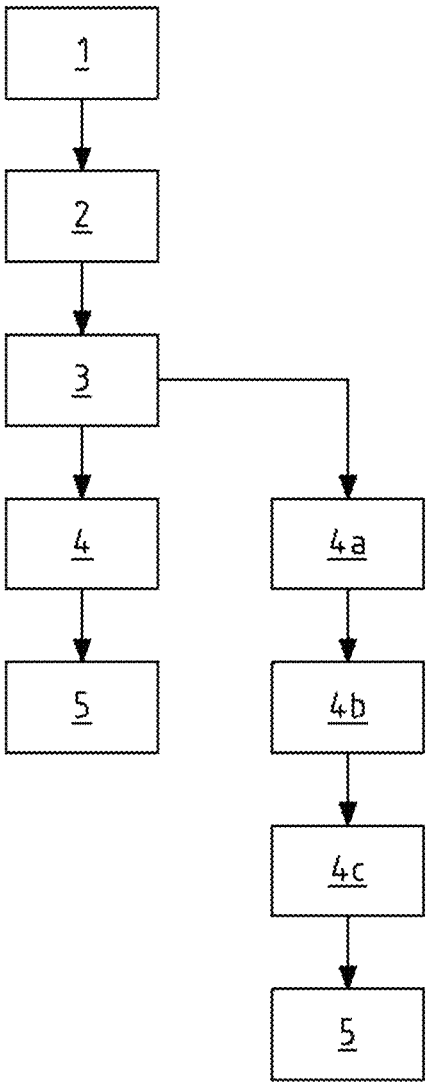
FIG. 1 is a schematic flow diagram of the manufacturing method of an aluminium alloy strip according to the invention.

FIG. 1 schematically shows the method steps and the sequence of an exemplary embodiment of a method for manufacturing aluminium alloy strips. In step 1, a rolling ingot is cast from an aluminium alloy with the following alloy components, for example in DC continuous casting:

Si≤0.10%, preferably ≤0.08%,

Fe≤0.25%, preferably ≤0.20%, 0.20%≤Mn≤0.30%, preferably 0.20%≤Mn≤0.26%, 4.72%≤Mg≤4.95%, preferably 4.80%≤Mg≤4.92%, Cu≤0.10%, preferably Cu≤0.07, particularly preferably Cu<0.04%, Cr≤0.02%, preferably Cr≤0.01%, particularly preferably Cr≤0.008%, Ni≤0.01%, preferably Ni≤0.005%, Zn≤0.10%, preferably Zn≤0.01%, particularly preferably Zn≤0.008%, Ti≤0.04%, preferably Ti≤0.02%, the remainder being Al with unavoidable impurities individually ≤0.05%, in total ≤0.15%.

The rolling ingot is then subjected to homogenisation in method step 2, which can be carried out in one or a plurality of stages. During homogenisation, temperatures of the rolling ingot are reached from 480 to 550° C. for at least 0.5 h. In method step 3, the rolling ingot is then hot-rolled. The end thicknesses of the hot strip are, for example, 3 to 6 mm. The hot strip end thickness can be selected such that only a cold rolling step 4 takes place after hot rolling, in which the hot strip is reduced in its thickness up to the end thickness with a rolling degree of 40% to 60%, preferably 50% to 60%. The aluminium alloy strip cold-rolled at end thickness is then subjected to soft annealing. Soft annealing is carried out in a continuous furnace at temperatures of more than 500° C., preferably at 510° C. to 540° C.

As also represented in FIG. 1, an alternative production method can also be used in which the hot-rolled aluminium alloy strip is first cold-rolled to an intermediate thickness in step 4a. The intermediate thickness is determined in such manner that the final rolling degree of the cold rolling at end thickness is 40% to 60%, preferably 50% to 60%. The intermediate annealing of the aluminium alloy strip is preferably carried out at 300° C. to 500° C., for example in the chamber furnace for at least 1.5 h or also in the continuous furnace for a maximum of 300 s. The intermediate annealing in step 4b can preferably be carried out either in the continuous furnace at 400° C. to 500° C. or in the chamber furnace at 330° C. to 450° C. The cold rolling of the aluminium alloy strip at end thickness is carried out in step 4c with a rolling degree of 40% to 60%, preferably 50% to 60%. The finished-rolled aluminium alloy strip is then soft-annealed in step 5 at more than 500° C., preferably at 510° C. to 540° C. in the continuous furnace.

Various aluminium alloy strips were manufactured using the alternative manufacturing method by carrying out intermediate annealing, wherein the end thickness of the exemplary embodiments and comparative examples was 1.2 mm in order to ensure comparability in the forming behaviour tests.

Table 1 shows the different alloy compositions, whereby all compositions also contain aluminium as a remainder as well as unavoidable impurities with individually a maximum of 0.05% by weight and in total a maximum of 0.15% by weight.

The comparative examples 1, 2 and 7 have, like exemplary embodiments 3 to 6, an aluminium alloy composition according to the invention.

The manufacturing parameters of exemplary embodiments 1 to 7 are specified in Table 2. The homogenisation of the rolling ingot was identical for all manufactured aluminium alloy strips and was 480° C. to 550° C. for at least 0.5 h. The pre-rolling of the rolling ingot with a starting temperature of at least 450° C. was ended in the comparative examples 1 and 7 at a sheet thickness of 32 mm. The exemplary embodiments of the invention 3 to 6 were pre-rolled up to a sheet thickness of 36 mm. In the comparative examples 1, 2 and 7 as well as in the exemplary embodiments 3 to 6, hot rolling ended with a reeling temperature of 300 to 350° C. at a hot strip end thickness of 3 to 6 mm.

The comparative example 7 was cold-rolled on the basis of an intermediate annealing thickness of 1.5 mm with a final rolling degree of 20%, the comparative example 1 with a rolling degree of 14.3% at end thickness. The comparative example 2 was manufactured with a rolling degree at end thickness of 50% and soft-annealed in a continuous furnace at 400° C. for 300 s. The comparative example 1 underwent an identical annealing process with a duration of 60 seconds.

The exemplary embodiments 3 to 6 were annealed at more than 500° C., here at 530° C. for 60 s in the continuous furnace and, like all other examples, then quenched in air.

The results of the tests are represented in Table 3. No Ae values were determined for comparative example 7. A comparison of the usual mechanical characteristic values for the forming, here the equal elongation Ag and elongation at break $A_{80mm}$, does not result in any clear differences between the comparative examples and the exemplary embodiments according to the invention. Nevertheless, the forming behaviour of the comparative examples and the exemplary embodiments in the manufacturing process of complex-shaped components is fundamentally different, which is due to the differences in the microstructure. This is clearly demonstrated by the investigations with regard to the main form change ε1 at 100 mm sample width according to Nakajima measured in accordance with DIN EN ISO 120004-2.

Figure 2:
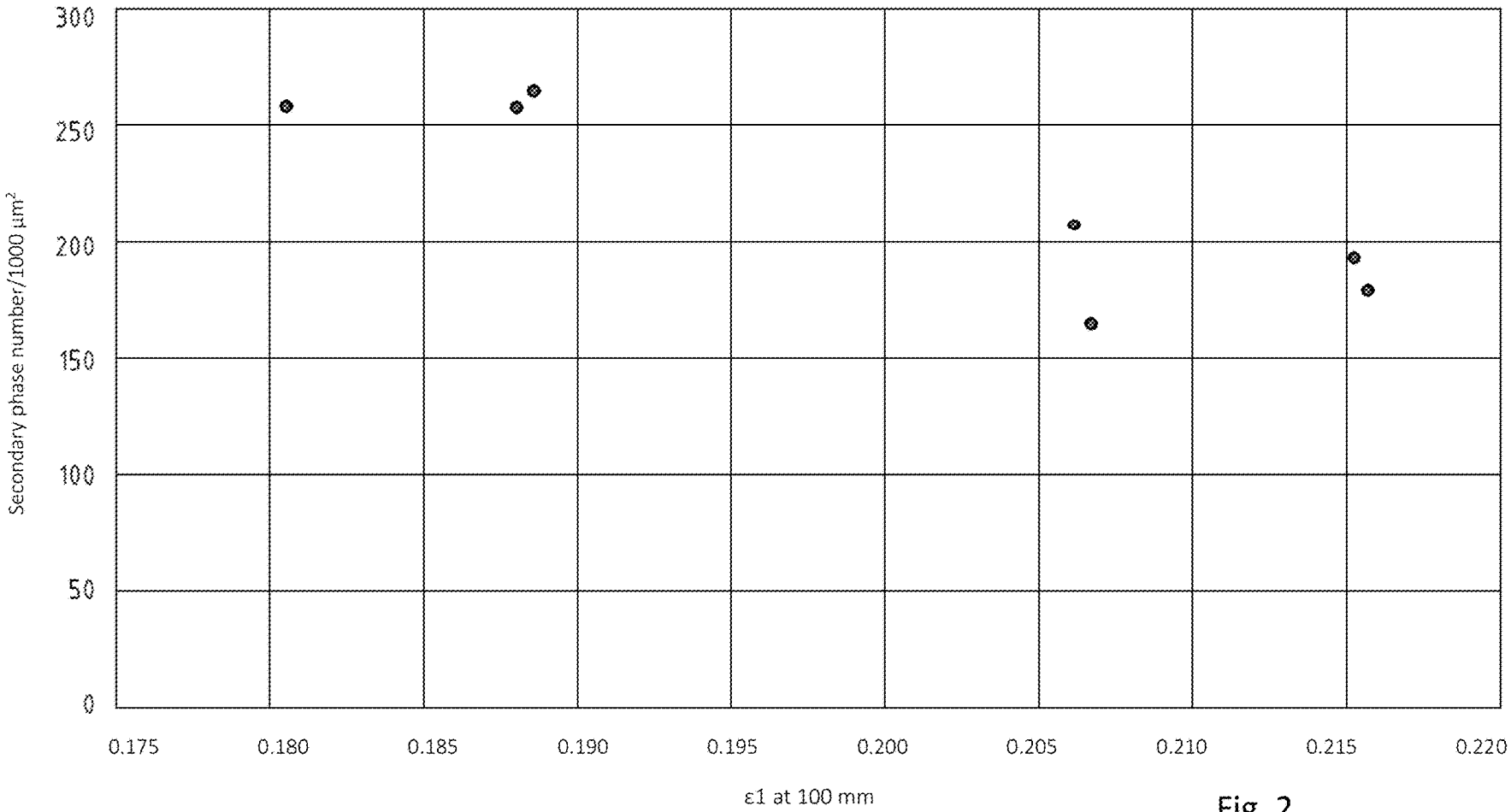
FIG. 2 is a diagram, the secondary phase density/1000 $\mu m^2$ as a function of the measured main form change ε1 at 100 mm sample width according to Nakajima.

The exemplary embodiments 3 to 6 according to the invention achieve between 9% 25 and almost 20% higher values here than the comparative examples. The result of the test of the main form change ε1 at 100 mm sample width was reflected in the material with a significant decrease in the secondary phase density to below 250 per 1000 $\mu m^2$. The secondary phase density was thereby determined in accordance with the above-mentioned method. FIG. 2 shows the determined values for comparison in the diagram.

Figure 4:
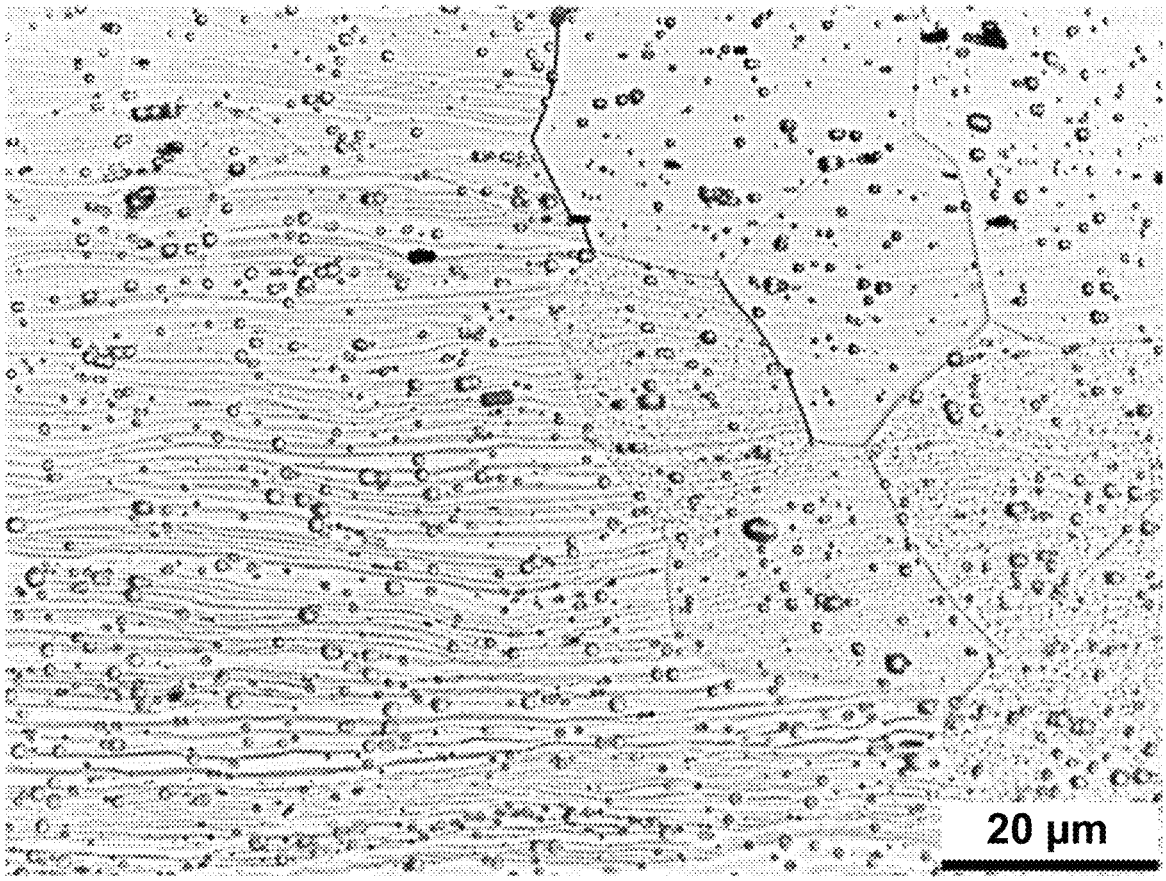
FIG. 4 is an etched section surface of an aluminium alloy strip according to the invention for evaluating the total number of secondary phases.

FIG. 4 shows an etched longitudinal section surface of an exemplary embodiment according to the invention. After grinding and polishing the section, the sample was etched for one minute at room temperature in a dilute aqueous solution of sulphuric acid and hydrofluoric acid. The solution consisted of 100 $cm^3$ of 10% concentrated sulphuric acid and was mixed with 100 $cm^3$ of another solution of sulphuric acid and hydrofluoric acid. The solution consisted of 100 $cm^3$ solution consisting of 60 $cm^3$ water and 40 $cm^3$ 5% hydrofluoric acid. After etching, the longitudinal section was rinsed with distilled water and dried for subsequent light microscopic examination. The etching marks the secondary phases.

At a magnification of 1000:1, the secondary phases were analysed using the light microscope with an oil lens. With this method, objects with a diameter of at least 0.39 μm can be detected and counted. In the etching used, the actual secondary phases are dissolved and pits are left, the size of which is significantly greater than the size of the secondary phases dissolved. This method can therefore be used to detect secondary phases significantly below the optical resolution of 0.39 μm. A comparison of the light-optical method used with scanning electron microscope examinations has shown that phases from approx. 50 nm can be determined statistically reliably. The total area of all examined measuring fields was 20331 $\mu m^2$. In FIG. 4, one of the measuring fields is represented as an example.

The yield strength values of the exemplary embodiments with 120 MPa transverse to the rolling direction also exhibited good suitability for the preferred application of the aluminium alloy strips for body inner parts of a motor vehicle. This also applies to the measured Ae value transverse to the rolling direction, which enables a forming with 0.7% and 0.6%, respectively, that is free of Lüders bands.

Table 3 does not represent the results of the grain size measurement, which 30 yielded an average grain size of the exemplary embodiments according to the invention of 20 μm to 29 μm according to ASTME 1382. Table 3 also does not represent the results of the corrosion tests, which showed a mass loss of 13.8 $mg/cm^2$ to 18.8 $mg/cm^2$ after a heat treatment of 45 minutes at 195° C. measured according to ASTM G67.

Figure 3:
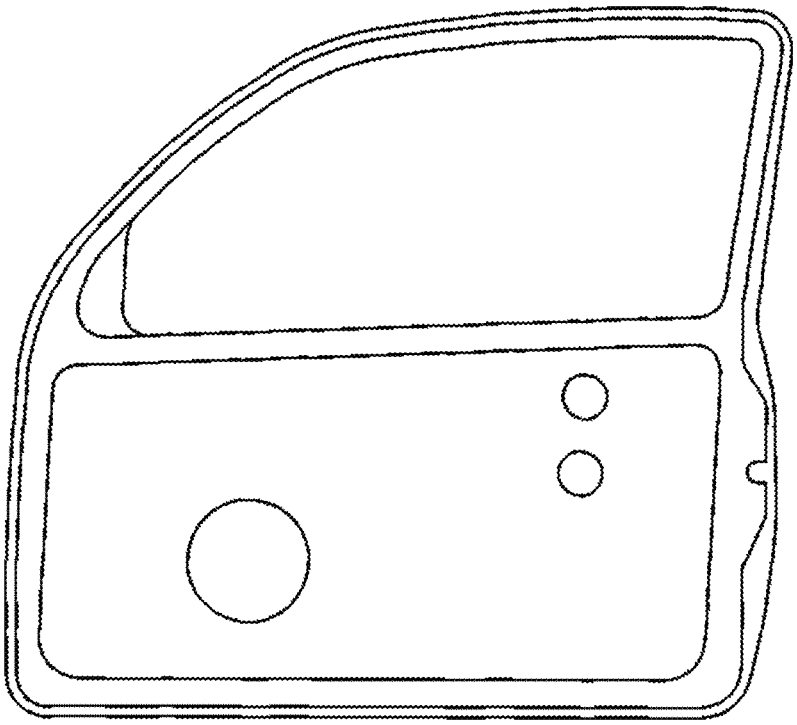
FIG. 3 is a typical use of the aluminium alloy strip in the form of a door inner part, the so-called "body in white" of a motor vehicle.

Lastly, FIG. 3 schematically shows a preferred use of the aluminium alloy strip, in which sheets are separated from the aluminium alloy strip and an inner part of a body of a motor vehicle in the form of a door inner part 6 has been manufactured by forming, for example drawing. These are usually manufactured from steel. The aluminium alloy strips according to the invention are therefore preferably used for the manufacture of body inner parts due to the improved forming behaviour with the same strength and corrosion resistance.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

The invention claimed is:

1. An aluminium alloy strip comprising an aluminium alloy with the following composition in % by weight Si≤0.10%, Fe≤0.25%, 0.20%≤Mn≤0.30%

4.72%≤Mg≤4.95%,

Cu≤0.10%,

Cr≤0.02%,

Ni≤0.01%,

Zn≤0.10%,

Ti≤0.04%, the remainder being Al and unavoidable impurities individually ≤0.05%, in total ≤0.15%, wherein the aluminium alloy strip has an average secondary phase density of less than 250/1000 $\mu m^2$, wherein the average secondary phase density results from the total number of the secondary phases determined in at least 10 measuring fields in relation to the total measuring surface of all examined measuring fields;

TABLE 1

| | No. | Si | Fe | Cu | Mn | Mg | Cr | Ni | Zn | Ti |
|---|---|---|---|---|---|---|---|---|---|---|
| Comparison | 1 | 0.08% | 0.18% | 0.0270 | 0.23% | 4.84% | 0.0016% | 0.0049% | 0.0040% | 0.0120% |
| Comparison | 2 | 0.08% | 0.22% | 0.0801 | 0.28% | 4.75% | 0.0078% | 0.0045% | 0.0081% | 0.0170% |
| Invention | 3 | 0.06% | 0.16% | 0.0302 | 0.26% | 4.86% | 0.0029% | 0.0045% | 0.0099% | 0.0129% |
| Invention | 4 | 0.08% | 0.17% | 0.0227 | 0.24% | 4.90% | 0.0036% | 0.0045% | 0.0062% | 0.0130% |
| Invention | 5 | 0.07% | 0.17% | 0.0233 | 0.23% | 4.80% | 0.0043% | 0.0049% | 0.0051% | 0.0145% |
| Invention | 6 | 0.07% | 0.17% | 0.0245 | 0.25% | 4.82% | 0.0022% | 0.0043% | 0.0047% | 0.0145% |
| Comparison | 7 | 0.07% | 0.22% | 0.0754 | 0.29% | 4.73% | 0.0052% | 0.0000% | 0.0071% | 0.0135% |

TABLE 2

| | No. | Homogenisation | End thickness, pre-rolling [mm] | Hot strip thickness [mm] | Intermediate annealing thickness [mm] | Rolling degree at end thickness [%] | Annealing temperature [° c.] | Time [sec] | Quenching |
|---|---|---|---|---|---|---|---|---|---|
| Comparison | 1 | 480-550° C. > 0.5 h | 32 | 3.5 | 1.4 | 14.3 | 400 | 60 | Air |
| Comparison | 2 | 480-550° C. > 0.5 h | 36 | 4.7 | 2.4 | 50.0 | 400 | 300 | Air |
| Invention | 3 | 480-550° C. > 0.5 h | 36 | 4.7 | 2.4 | 50.0 | 530 | 60 | Air |
| Invention | 4 | 480-550° C. > 0.5 h | 36 | 4.7 | 2.4 | 50.0 | 530 | 60 | Air |
| Invention | 5 | 480-550° C. > 0.5 h | 36 | 4.7 | 2.4 | 50.0 | 530 | 60 | Air |
| Invention | 6 | 480-550° C. > 0.5 h | 36 | 4.7 | 2.4 | 50.0 | 530 | 60 | Air |
| Comparison | 7 | 480-550° C. > 0.5 h | 32 | 3.4 | 1.5 | 20.0 | 530 | 300 | Air |

TABLE 3

| | No. | Rp0.2 Q [MPa] | Ae Q [%] | Ag Q [%] | A80 [%] | ε1 @100 mm | Secondary phase density [number/1000 $\mu m^2$] |
|---|---|---|---|---|---|---|---|
| Comparison | 1 | 115 | 0.4 | 22.2 | 24.9 | 0.189 | 266 |
| Comparison | 2 | 130 | 0.9 | 23.5 | 26.1 | 0.181 | 260 |
| Invention | 3 | 120 | 0.7 | 23.8 | 27.2 | 0.206 | 202 |
| Invention | 4 | 120 | 0.7 | 23.5 | 27.6 | 0.216 | 178 |
| Invention | 5 | 120 | 0.6 | 23.2 | 26.9 | 0.215 | 192 |
| Invention | 6 | 120 | 0.6 | 23.9 | 27.3 | 0.207 | 171 |
| Comparison | 7 | 120 | — | 21.9 | 26.1 | 0.188 | 259 |

wherein the aluminium alloy strip has an average grain size of 15 μm to 30 μm measured according to ASTM E1382;

wherein the aluminium alloy strip has an Ae value according to DIN EN ISO 6892 transverse to a rolling direction of less than 0.9%; and wherein the aluminium alloy strip has a mass loss of 13 $mg/cm^2$ to 19 $mg/cm^2$ after a thermal load of 195° C. for 45 minutes measured according to ASTM G67.

2. The aluminium alloy strip according to claim 1, wherein one or a plurality of alloy components of the aluminium alloy of the aluminium alloy strip have the following contents in % by weight:

Si≤0.08%,
Fe≤0.20%,
0.20%≤Mn≤0.26%,
4.80%≤Mg≤4.92%,
Cu≤0.07,
Cr≤0.01,
Ni≤0.005%,
Zn≤0.01%,
0.005%≤Ti≤0.02%.

3. The aluminium alloy strip according to claim 1, wherein the aluminium alloy strip has an average secondary phase density of less than 220/1000 $\mu m^2$.

4. The aluminium alloy strip according to claim 1, wherein the aluminium alloy strip has a microstructure state O or H111.

5. The aluminium alloy strip according to claim 1, wherein the aluminium alloy strip is cold-rolled and optionally has a thickness of 0.5 mm to 4 mm.

6. The aluminium alloy strip according to claim 1, wherein the aluminium alloy strip at a sheet thickness of 1.2 mm has an average main ε1 form change 1 at a sample width of 100 mm according to DIN EN ISO 120004-2 in the test according to Nakajima of more than 0.200.

7. The aluminium alloy strip according to claim 1, wherein the aluminium alloy strip has a yield strength Rp0.2 transverse to the rolling direction of at least 115 MPa according to DIN EN ISO 6892.

8. A method for manufacturing the aluminium alloy strip according to claim 1, wherein the method has the following steps:

Casting of a rolling ingot from said aluminium alloy omogenising the rolling ingot at 480° C. to 550° C. for at least 0.5 h, hot rolling of the rolling ingot to form a hot strip with an end thickness of 3 to 6 mm, cold rolling of the hot strip to an end thickness with a rolling degree of 40% to 60% to provide a finished rolled aluminium alloy strip, and soft annealing of the finished rolled aluminium alloy strip at more than 500° C. in a continuous furnace.

9. A method for manufacturing the aluminium alloy strip according to claim 1, wherein the method has the following steps:

Casting of a rolling ingot from said aluminium alloy, omogenizing the rolling ingot at 480° C. to 550° C. for at least 0.5 h, hot rolling of the rolling ingot to form a hot strip with an end thickness of 3 to 6 mm, cold rolling of the hot strip to an intermediate thickness determined in such manner that a final cold rolling degree to an end thickness is 40% to 60%, intermediate annealing of the aluminium alloy strip at 300° C. to 500° C., cold rolling of the aluminium alloy strip to an end thickness with a rolling degree of 40% to 60% to provide a finished rolled aluminium alloy strip, soft annealing of the finished rolled aluminium alloy strip at more than 500° C. in a continuous furnace.

10. The method according to claim 8, wherein the duration of the soft annealing of the finished aluminium alloy strip in the continuous furnace is between 5 s and 300 s.

11. The method according to claim 8, wherein the hot rolling of the rolling ingot consists of the steps pre-rolling to a thickness of 30 mm to 40 mm at a starting temperature of at least 450° C. and finishing hot rolling to hot strip end thickness with a reeling temperature of 300° C. to 350° C.

12. A method comprising:

manufacturing a body inner part from the aluminium alloy strip according to claim 1.

13. The aluminium alloy strip according to claim 2, wherein one or a plurality of alloy components of the aluminium alloy of the aluminium alloy strip have the following contents in % by weight:

Cu<0.04%,
Cr≤0.008%, and
Zn≤0.008%.

14. The aluminium alloy strip according to claim 1, wherein the aluminium alloy strip has an average secondary phase density of less than 200/1000 $\mu m^2$.

15. The aluminium alloy strip according to claim 1, wherein the aluminium alloy strip has a yield strength Rp0.2 transverse to the rolling direction of at least 120 MPa according to DIN EN ISO 6892.

16. The method according to claim 12, wherein the body inner part is a door inner part, an engine hood inner part, or a trunk cover inner part of a motor vehicle.

* * * * *